US006247484B1

(12) United States Patent
Thomas

(10) Patent No.: US 6,247,484 B1
(45) Date of Patent: Jun. 19, 2001

(54) EAVE CONSTRUCTION FOR LARGE CANOPIES

(75) Inventor: James H. Thomas, Oklahoma City, OK (US)

(73) Assignee: Layne Christensen Company, Misson Woods, KS (US)

( * ) Notice: Subject to any disclaimer, the term of this patent is extended or adjusted under 35 U.S.C. 154(b) by 0 days.

(21) Appl. No.: 09/496,640

(22) Filed: Feb. 2, 2000

(51) Int. Cl.[7] ..... E04H 15/34

(52) U.S. Cl. ..... 135/123; 135/127; 135/120.3; 52/83; 52/18

(58) Field of Search ..... 52/3, 18, 22, 80.2, 52/83; 135/87, 90, 908, 909, 100, 97, 121, 123, 127, 120.3

(56) References Cited

U.S. PATENT DOCUMENTS

| | | | |
|---|---|---|---|
| 1,481,019 | | 1/1924 | Luebbert . |
| 1,808,693 | | 6/1931 | Terzoli . |
| 1,839,076 | | 12/1931 | Adams . |
| 2,239,399 | | 4/1941 | Pandya . |
| 2,355,008 | | 8/1944 | Moran . |
| 2,493,749 | | 1/1950 | Brown et al. . |
| 2,693,195 | | 11/1954 | Frieder et al. . |
| 3,807,421 | | 4/1974 | Geiger et al. . |
| 4,068,404 | | 1/1978 | Sheldon . |
| 4,320,603 | | 3/1982 | Kirschen . |
| 4,877,044 | * | 10/1989 | Cantwell ..... 135/104 |
| 4,982,534 | | 1/1991 | Saitoh et al. . |
| 5,010,695 | | 4/1991 | Schildge, Jr. . |
| 5,582,197 | * | 12/1996 | Dobberstein ..... 135/87 |
| 5,597,005 | | 1/1997 | Thomas . |

* cited by examiner

*Primary Examiner*—Beth A. Stephan
(74) *Attorney, Agent, or Firm*—Shook, Hardy & Bacon LLP

(57) ABSTRACT

A protective canopy constructed to discharge snow from the cover. A plurality of posts support cables on which a flexible cover is supported. A sleeve formed on the eave edge of the cover is provided with a pipe at each seam between adjacent panels of the cover. Elongated rods extend in the sleeve between the pipes. The rods normally provide a straight horizontal eave. If snow builds up unduly on the cover, the rods can bow downwardly so that chutes are formed to allow the snow to slide off. Clamp brackets are fitted around the pipes and pulled to pull the cover taut before being clamped to the cables to secure the cover in a taut condition.

20 Claims, 2 Drawing Sheets

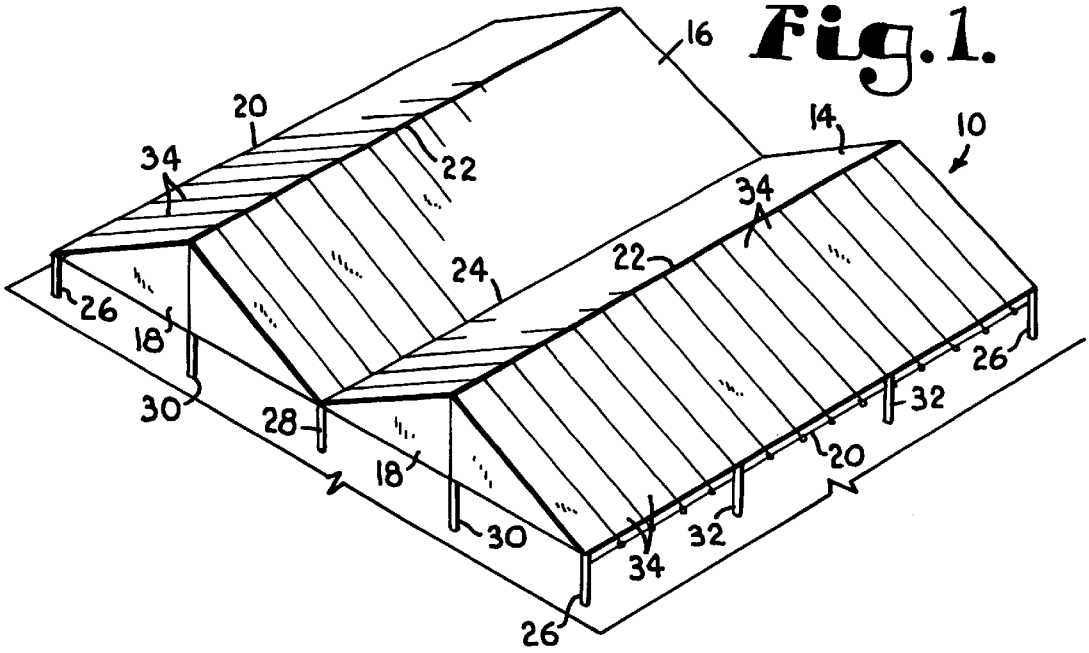
Fig.1.
Fig.2.
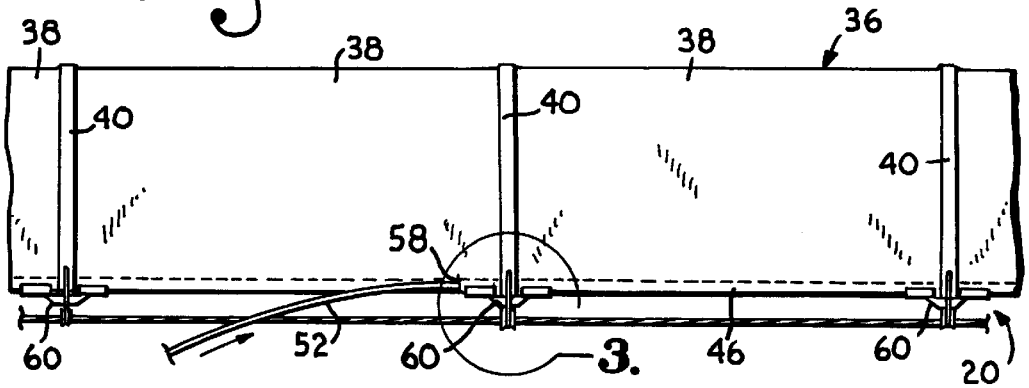
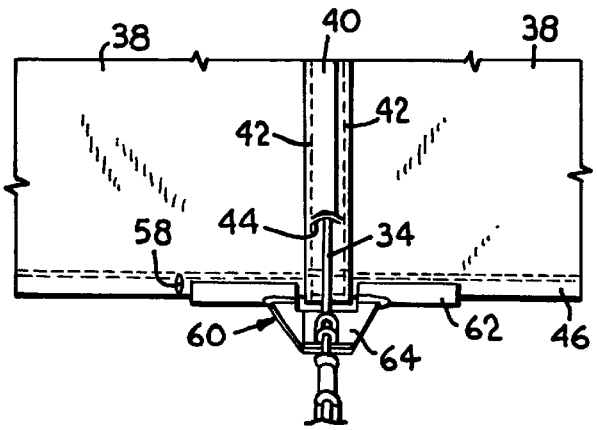
Fig.3.

EAVE CONSTRUCTION FOR LARGE CANOPIES

FIELD OF THE INVENTION

This invention relates generally to large canopies such as the type that provides protection and shade for vehicles in automobile lots and other large areas that require a protective cover. More particularly, the invention is directed to an eave construction that prevents undue buildup of snow and other loads on the canopy cover.

BACKGROUND OF THE INVENTION

U.S. Pat. No. 5,597,005 to Thomas discloses a canopy structure that is intended for use to cover parking lots, automotive dealer lots, and other large areas in order to provide protection from hail and other inclement weather conditions, as well as to serve as a sun shade. The canopy is constructed using upright posts which support cables that in turn support a flexible cover. Although this type of canopy functions well for the most part, it is not wholly free of problems under all conditions.

In particular, when the canopy is installed in an area that is subject to heavy snowfall, the snow can build up unduly on top of the cover. Between the support cables, the cover can sag when ice, snow, and other loads are applied to it. Because the eaves are held in a substantially rigid condition by taut cables that extend along the eaves, the cover can sag below the level of the eave and create a "cup" condition. Cupped areas are prone to receiving snow and ice to the point where the load becomes so heavy that the structure can fail. This obviously creates a serious problem in geographic areas where heavy snow falls are prevalent.

SUMMARY OF THE INVENTION

The present invention is directed to a large canopy that is provided with a specially constructed eave structure designed to discharge snow and other materials from the canopy cover before they accumulate unduly and apply loads heavy enough to cause structural damage or other serious problems.

It is the primary object of the invention to provide a canopy eave construction that functions to dump snow and other materials from the canopy before they build up to a point where excessive loads are applied to the cover. Other objects of the invention are to provide an eave construction of the character described which is simple and economical to manufacture and install, which functions in a reliable manner, and which is effective in harsh climates.

The function of discharging snow from the cover is achieved primarily by a unique pipe and rod arrangement that is installed on the eave of the cover, and also by the provision of a special clamp bracket that holds the cover tightly on the support cables to minimize cupping.

In accordance with the invention, hollow pipes are installed in a sleeve which is formed on the edge of the cover that extends along each eave of the canopy structure. The pipes are located at each of the seams which provide channels or passages in the cover that receive parallel support cables extending to the eaves. A rod extends in the sleeve between each pair of pipes. The rods are stiff enough to normally maintain the eave in a straight horizontal configuration. However, if snow or other loads should accumulate on the cover between the support cables, the rods are flexible enough to bow downwardly before the load becomes excessive. Then, the center portion of the rod bows downwardly to a low enough position that a chute is formed allowing the snow to slide downwardly off of the cover and past the eave. Once the snow has been discharged, the rods snap back to their normally straight condition extending along the eave.

Another important feature of the invention is the provision of clamp brackets which allow the cover to be pulled tightly so that the tendency for the cover to cup is minimized. The clamp brackets are applied to the sleeve at the eave of the canopy at the locations of the seams. Each bracket has a barrel which extends around the sleeve and closely receives one of the pipes. The brackets can be pulled to pull the cover tautly on the support cables.

Each bracket has a clamp which can be tightened onto the corresponding support cable to maintain the cover in a taut condition. The clamp structure may take the form of U-bolts receiving nuts that may be tightened to clamp the cable tightly between the U-bolts and a plate portion of the bracket. The support cables may have looped ends through which an eave cable can be strung to locate the eave cable outwardly from the sleeve, thereby providing a space wide enough to accommodate the snow or other materials that are discharged past the eave.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a perspective view of a canopy of the type that may be provided with an improved eave constructed in accordance with the present invention;

FIG. 2 is a fragmentary top plan view on an enlarge scale showing a portion of the eave structure of the canopy of FIG. 1, with one of the rods being inserted into a sleeve formed on the edge of the canopy cover;

FIG. 3 is a fragmentary plan view on an enlarge scale showing detail 3 designated in FIG. 2;

DETAILED DESCRIPTION OF THE INVENTION

Figure 4:
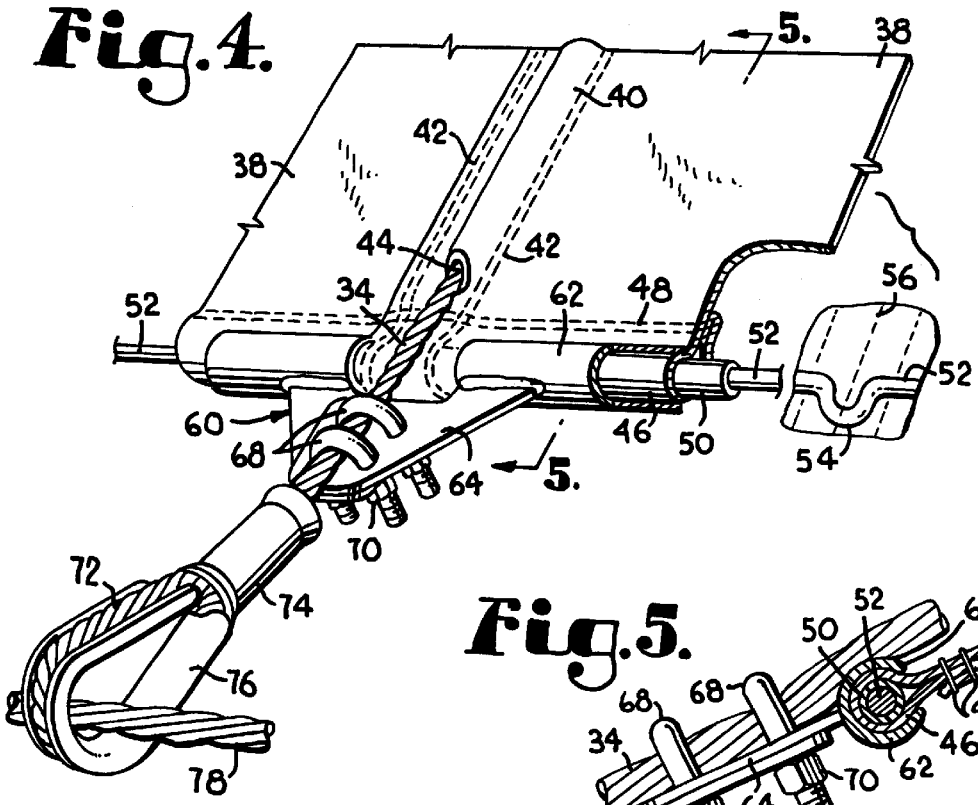
FIG. 4 is a fragmentary perspective view on an enlarge scale showing the eave structure, with portions broken away for purposes of illustration.

Referring now to the drawings in more detail and initially to FIG. 1, numeral 10 generally designates a large canopy which is constructed in accordance with the present invention. The canopy 10 is used to cover automotive dealer lots, parking lots, and other relatively large areas that require protection from inclement weather conditions such as hail storms. The canopy 10 may also serve as a sun shade for the protection of vehicles and other objects. The canopy 10 is intended to be a substantially permanent structure rather than one that is intended to be periodically assembled and disassembled such as a circus tent or other similar structure.

The canopy 10 may be constructed for the most part in the manner disclosed in U.S. Pat. No. 5,597,005 to Thomas which is incorporated by reference and to which reference may be made for a more detailed description of the various components of the canopy. The canopy 10 may take a variety of configurations, such as the configuration shown in FIG. 1 which includes a pair of roof structures 14 and 16 connected side to side. The canopy 10 includes gables 18 on its opposite sides and eaves 20 extending between the gable sides of the structure. A pair of ridges 22 are located on the two structures 14 and 16, and a valley 24 is formed between the peaks or ridges 22.

The canopy 10 is supported by a post and cable system which includes upright comer posts 26 located at the four comers of the structure. On the gable sides of the structure, a valley post 28 is located midway between the comer posts 26, and a pair of ridge posts 30 are located between the valley post 28 and each of the corner posts 26. On the eave ends of the structure, a plurality of eave posts 26 are spaced apart from one another between the comer posts 26. A plurality of intermediate valley posts (not shown) are spaced apart along the valley 24 between the two valley posts 28. Similarly, a plurality of intermediate ridge posts 30 are spaced apart along each of the ridges 22 between the two ridge posts 30 provided for each ridge.

The framing for the canopy 10 includes a plurality of framing cables (not shown) which are interconnected with the various posts and with one another, as more specifically disclosed in U.S. Pat. No. 5,597,005. Also included are cables which extend along the ridges 22, along the valleys 24, and along the lower edges of the gable sides of the canopy structure.

A plurality of cover support cables 34 extend generally parallel to one another between the opposite eaves 20, with the support cables 34 extending over the ridges 22 and the valley 24. Each support cable 34 has its opposite ends located adjacent to the two eaves 20.

The support cables 34 provide support for a flexible cover which is generally identified by numeral 36. With additional reference to FIGS. 2–4, the cover 36 is constructed by connecting a plurality of flexible strips or panels 38. The panels 38 are connected together edge to edge at seams 40 which are formed at the panel junctions. As described in U.S. Pat. No. 5,597,005, the seams 40 are formed by looping the edges of adjacent panels 38 together and stitching the looped portions at 42 to form a channel or passage 44 along each of the seams 40. Each of the passages 44 receives one of the cover support cables 34 so that the cover 36 is supported on the cables 34. The end of each passage 44 adjacent to one of the eaves is open so that the corresponding cable 34 extends out through the end of the passage, as best shown in FIG. 4.

The cover 36 may be constructed of any suitable material such as a fabric formed from high density polyethylene. By way of example, the fabric panels 38 may be approximately nine feet wide each so that the adjacent support cables 34 are spaced about nine feet apart. The panels 38 extend in a taut condition between the support cables 34.

As shown particularly in FIG. 4, the eave edges of the fabric panels 38 are formed in a loop to provide a continuous sleeve 46 extending along each eave of the cover 36. Stitching 48 secures each of the looped edges in the form of the sleeve 46.

A rigid pipe 50 which is hollow and open at both ends is installed in each sleeve 46 adjacent to the location of each seam 40. By way of example, each pipe 50 may be approximately one foot long with its center located at the center of the corresponding seam 40. The eave structure of the canopy includes a plurality of elongated metal rods 52. One of the rods 52 extends between each adjacent pair of the pipes 50. The rods 52 are located within sleeve 46 and extend at their opposite ends into the open end of the pipes 50. By way of example, each rod may be approximately nine feet long with approximately six inches of each end portion of the rod received in the pipes 50. As shown somewhat diagrammatically in FIG. 4, each rod 52 is bent near its center to provide a generally U-shaped bend 54 which may be stitched at 56 to the cover 36. This arrangement maintains each of the rods 52 generally centered relative to the width of the adjacent fabric panel 38 so that neither end of the rod slides completely out of pipe 50. However, the rods 52 are received in pipes 50 loosely so that they can slide inwardly and outwardly.

The rods 52 are preferably constructed of metal and are relatively stiff. The rods are normally arranged with their ends adjacent to each other. Each rod normally extends in a relatively straight condition to provide each eave 20 with a substantially horizontal structure that maintains the eave 20 in a relatively straight and horizontal condition. However, the rods 52 are flexible enough that they can flex or bow downwardly when heavy loads are applied to the canopy, as will be explained more fully. By way of example, each of the pipes 50 may have an outside diameter of approximately ¾ inch, while the rods may each be ¼ inch in diameter.

With particular reference to FIG. 2, the sleeve 46 may be provided with a slit 58 near each of the seams 40. The slits 58 allow the pipes 50 to be inserted into the sleeve 46 in the field, and the slits also allow the rods 52 to be inserted into the sleeve and also into the pipes 50. Preferably, each of the slits 58 is stitched closed in the field after the pipes and rods have been installed.

Figure 5:
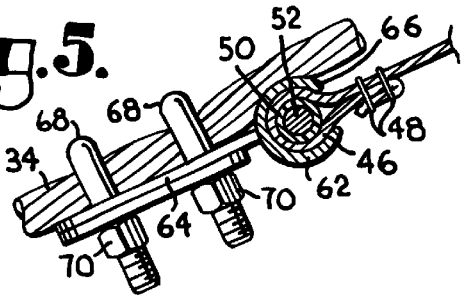
FIG. 5 is a fragmentary sectional view taken generally along line 5—5 of FIG. 4 in the direction of the arrows.
Figure 6:
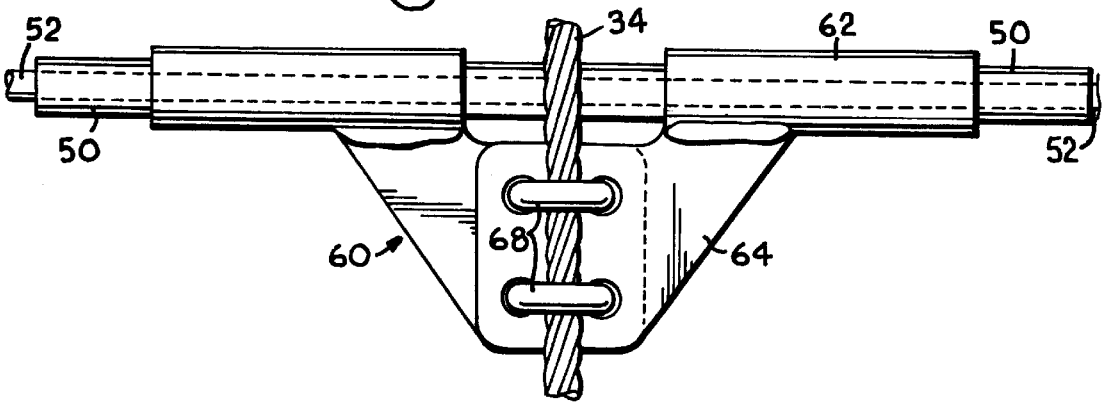
FIG. 6 is a fragmentary top plan view showing the clamp bracket depicted in FIG. 4.
Figure 7:
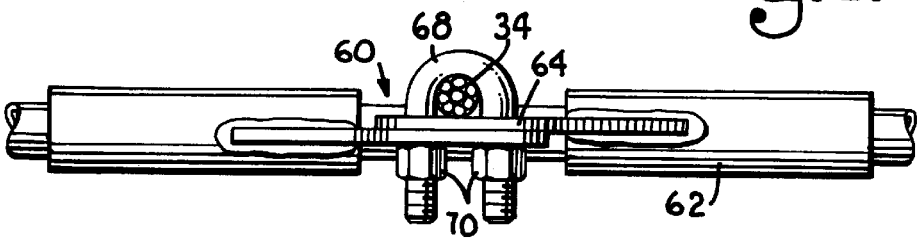
FIG. 7 is an end elevational view of the clamp and related components shown in FIG. 6.

A plurality of rigid brackets 60 are provided in order to tautly secure the fabric panels 38. Each bracket 60 may be constructed by connecting two identical halves together, with one of the parts inverted relative to the other. Each bracket 60 includes a discontinuous barrel 62 which is open at the center. A substantially flat bracket plate 64 extends from the barrel 62 of each bracket. As best shown in FIG. 5, each of the barrels 62 is generally cylindrical but is provided with a discontinuity or gap 66 allowing it to be fitted onto the sleeve 46. One of the brackets 60 is provided at each of the seams 40, and the brackets are applied to the sleeve 46 such that the pipes 50 are thereafter closely received within the barrels 62.

The plates 64 are located such that the end portion of the corresponding support cable 34 extends along the top surface of plate 64. The plates 64 of the two halves of each bracket are provided with aligned sets of holes allowing a pair of U-bolts 68 to be extended through the holes. The U-bolts 68 are applied to the cable 34 such that the cable is received between the bight portions of the U-bolts and the bracket plate 64. Nuts 70 may be applied to the ends of the U-bolts and tightened against the underside of plate 64 in order to securely clamp the cable 34 to the brackets 60, as well as to secure the halves of the brackets together.

The brackets 60 may be applied to the eave portion of the canopy and then pulled outwardly, either by hand or with a suitable tool in order to pull the cover 36 along cables 34 until the cover is in a suitably taut condition. Then, the nuts 70 are tightened to clamp the brackets 60 and cable 34 together, thereby assuring that the cover is maintained in a taut condition.

Each support cable 34 extends outwardly beyond the corresponding bracket 62 and is provided with a looped end 72 secured in a looped configuration by a cable clamp 74 or other suitable fastener. A metal wear strip 76 may be secured within the looped end 72 of each cable 34.

Along each of the eaves 20, an eave cable 78 is extended through the loops 72 on the ends of the support cables. The eave cable 78 is maintained in a taut condition and is spaced outwardly a selected distance from the fabric sleeve 46 to provide a space through which snow and other materials may be discharged from the canopy. The spacing between the sleeve 46 and eave cable 78 may be selected as desired, dependent primarily on the amount of snow expected in the climate where the canopy is to be installed.

The canopy 10 of the present invention is particularly characterized by the ability to discharge ice, snow, and other materials that may unduly build up on the cover 36. Flexible covers such as the cover 36 tend to sag at locations between the support cables 34 when snow and other loads are applied to the top of the cover. Such sagging tends to create "cups" at locations near the eaves 20, and the cups provide sagging areas in which snow and other materials can build up excessively and apply forces that are large enough to cause rupture or other structural damage to the canopy.

The excessive accumulation of snow and other materials is avoided by the eave construction of the present invention. If one or more of the panels 38 is loaded with snow, ice, or another material that tends to build up and create a cupping effect in the panel, the resulting load that is applied to the eave 20 is received by the corresponding rod 52. If the load reaches a sufficiently high level, the rod 52 bows downwardly near its center, thereby lowering that portion of the eave and allowing the material to slide off of the panel 38 and over the sleeve 46. The rod 52 bows such that a chute is formed midway between the seams 40, with the chute configuration providing a path for the snow to discharge under the influence of gravity. The material discharges from the cover 36 through the space that is presented between the eave cable 78 and the sleeve 46.

As the rod 52 flexes or bows downwardly, its ends slide outwardly in the pipes 50. It is contemplated that with the rods 52 extending approximately six inches into the pipes 50 at the opposite ends of the rods, the rods will slide outwardly at the most about three inches so that approximately three inches of each end of the rod remains in the pipe 50 to assure continuous structural integrity of the eave. Thus, at even the maximum deflection of rod 52, enough of the rod remains extended into the pipes 50 to prevent the eave from failing structurally.

Once the load has been discharged from the fabric panel 38, the stiffness of the rod 52 causes it to spring or snap back to its normal straight condition. Consequently, the rod again assumes its normal straight condition extending horizontally along the eave of the canopy. The securement provided by the bend 54 and stitching 56 assists in maintaining the ends of the rods 52 at least partially in the pipes 50 at all times.

In addition to this automatic snow removal, the invention also features the clamp brackets 60 which facilitate pulling the cover 36 into a taut condition on the support cables 34 and securely clamping the cable 34 to each bracket 60 in order to secure the cover in a taut condition. This tautness opposes any tendency for the fabric panels to cup in the first place and thus provides assistance in preventing undue buildup of snow, ice, or other materials on the roof of the canopy 10.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. In a canopy structure which includes a plurality of posts, a plurality of cables supported on the posts, a flexible cover supported on the cables, and a sleeve on the cover extending along an eave of the structure, an improved eave construction comprising an elongate rod in the sleeve sufficiently stiff to normally extend in a substantially straight condition but flexing to bow downwardly when heavy materials are on the cover, thereby allowing the materials to slide off of the cover with the rod thereafter resuming a substantially straight condition.

2. An eave construction as set forth in claim 1, including a pair of pipes in the sleeve receiving said rod at opposite end portions thereof.

3. An eave construction as set forth in claim 2, including:

a bracket applied to said sleeve and to at least one of said pipes to allow the cover to be pulled tautly on the cables; and a clamp on the bracket secured thereto and clamped to one of the cables to secure the cover to said one cable in a taut condition.

4. An eave construction as set forth in claim 3, including:

a looped end portion of said one cable spaced outwardly from the sleeve; and an eave cable extending through said looped end portion of said one cable.

5. An eave construction as set forth in claim 1, including a securement securing an intermediate portion of said rod to said cover.

6. An eave construction as set forth in claim 2, including a securement securing an intermediate portion of said rod to said cover to prevent the rod from sliding completely out of either pipe when the rod bows downwardly.

7. An eave construction as set forth in claim 1, including:

a bend in an intermediate portion of said rod; and stitching securing said bend to the cover.

8. An eave construction as set forth in claim 1, including a slit in said sleeve at a preselected location to allow insertion of said rod into said sleeve.

9. An cave construction for a canopy structure having a plurality of posts, a plurality of cables supported on the posts, and a flexible cover supported on the cables, said eave construction comprising:

a sleeve on an edge of the cover extending along an eave of the structure;

a pair of pipes secured in said sleeve at selectively spaced locations therein; and an elongate rod in said sleeve having opposite end portions fitting slidably in said pipes, said rod being sufficiently stiff to normally extend in a substantially straight condition between said pipes but flexing downwardly in response to application of heavy materials to the cover to thereby allow the materials to slide off of the cover past the eave of the structure.

10. An eave construction as set forth in claim 9, wherein:

said cables include a plurality of generally parallel cover support cables having end portions adjacent to the eave of the structure;

said cover includes a plurality of seams along which the cover support cables extend; and said pipes are located in said sleeve at adjacent seams.

11. An eave construction as set forth in claim 10, including:

a pair of brackets applied to said sleeve and to the respective pipes to allow the cover to be pulled tautly on a pair of the support cables which extend along the seams corresponding to the locations of said pipes; and a clamp on each bracket secured thereto and clamped to the corresponding support cable in said pair thereof to secure the cover to said pair of support cables in a taut condition.

12. An eave construction as set forth in claim 11, including:

a looped end portion of each support cable in said pair thereof spaced outwardly from said sleeve; and an eave cable extending through said looped end portions.

13. An eave construction as set forth in claim 9, wherein said rod is secured to the cover at a location intermediate said opposite end portions of the rod.

14. An eave construction as set forth in claim 9, including a slit in said sleeve accommodating insertion of said rod into the sleeve.

15. An cave construction as set forth in claim 9, including:

a pair of brackets each having a barrel portion extending partially around said sleeve and the respective pipes therein to allow said brackets to pull the cover tautly on the cables; and a clamp on each bracket adapted to clamp onto an adjacent cable to secure the cover thereto in a taut condition.

16. A canopy structure for covering large surfaces such as parking lots, comprising:

a plurality of posts spaced apart from one another;

a plurality of cables including cables extending between the posts and a plurality of generally parallel cover support cables having end portions adjacent to an eave of the structure;

a flexible cover having a plurality of panels connected edge to edge at seams providing passages through which said support cables extend, said cover having an edge formed as a sleeve extending along the eave of the structure;

a plurality of hollow pipes in said sleeve, one pipe located adjacent to each seam; and a plurality of elongate rods in said sleeve each extending between an adjacent pair of pipes to situate the rods generally end to end with the rods being slidable in the pipes, each rod being sufficiently stiff to normally maintain a substantially straight condition but flexing downwardly between the pipes when heavy material is loaded on the cover between the corresponding seams, thereby allowing the material to slide off of the cover with the rod thereafter resuming a substantially straight condition.

17. A canopy structure as set forth in claim 16, including:

a bracket applied to said sleeve and to at least one of said pipes to allow the cover to be pulled tautly on the cables; and a clamp on the bracket secured thereto and clamped to one of the cables to secure the cover to said one cable in a taut condition.

18. A canopy structure as set forth in claim 17, including:

a looped end portion of said one cable spaced outwardly from the sleeve; and an eave cable extending through said looped end portion of said one cable.

19. A canopy structure as set forth in claim 16, including a slit in said sleeve adjacent each seam to allow insertion of said pipes and rods into the sleeve.

20. A canopy structure for covering large surfaces such as parking lots, comprising:

a plurality of posts spaced apart from one another;

a plurality of cables including cables supported on said posts and a plurality of generally parallel cover support cables having end portions adjacent an eave of the canopy structure;

a flexible cover supported on said cover support cables and having a sleeve extending generally along said eave;

an eave structure in said sleeve providing rigidity thereto;

a plurality of brackets spaced apart along the eave, each bracket having a barrel portion extending partially around said sleeve and receiving said eave structure in the barrel so that pulling on the brackets pulls the cover tautly on said support cables; and a clamp on each bracket clamped onto an adjacent support cable to secure the cover thereto in a taut condition.

* * * * *